US007188823B2

(12) United States Patent
Meyer

(10) Patent No.: US 7,188,823 B2
(45) Date of Patent: Mar. 13, 2007

(54) ELECTROMAGNETIC VALVE OPERATING DEVICE WITH ADJUSTABLE NEUTRAL POSITION

(75) Inventor: Johannes Meyer, Karlsfeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/104,512

(22) Filed: Apr. 13, 2005

(65) Prior Publication Data

US 2005/0178990 A1 Aug. 18, 2005

Related U.S. Application Data

(63) Continuation of application No. PCT/EP2003/010330, filed on Sep. 17, 2003.

(30) Foreign Application Priority Data

Oct. 17, 2002 (DE) ..... 102 48 330

(51) Int. Cl.
*F16K 31/02* (2006.01)

(52) U.S. Cl. ..... 251/129.1; 251/129.16; 251/129.18; 123/90.11; 123/90.39; 335/268

(58) Field of Classification Search ..... 251/129.09, 251/129.1, 129.16, 129.18; 335/266, 268; 123/90.11, 90.39, 90.4
See application file for complete search history.

(56) References Cited

U.S. PATENT DOCUMENTS 4,455,543 A 6/1984 Pischinger et al.
5,117,213 A 5/1992 Kreuter et al.
6,070,853 A 6/2000 Stolk et al.
6,257,182 B1 7/2001 Hara et al.
6,830,018 B2 * 12/2004 Sugimoto et al. ..... 123/90.11

FOREIGN PATENT DOCUMENTS

DE 696 01 805 T2 1/1996
DE 199 52 052 A1 10/1999

* cited by examiner

*Primary Examiner*—J. Casimer Jacyna
(74) *Attorney, Agent, or Firm*—Crowell & Moring LLP

(57) ABSTRACT

An electromagnetic valve actuating mechanism for an internal combustion engine has an axially displaceable control element with an armature plate, for opening or closing a valve. Two solenoids are arranged behind one another in the displacement direction and spaced with respect to one another. One solenoid is arranged on the side of the armature plate close to the valve and the other is on the side away from the valve. Two springs are arranged behind one another in the displacement direction, one of the springs being arranged on the side of the armature plate close to the valve and the other being arranged on the side away from the valve. The control element, which is held in a neutral position when the solenoids are currentless, is deflectable from its neutral position by energizing the solenoids. An adjusting element, which rests on the end of one of the two springs away from the armature plate, is adjustable to change the prestressing of the springs and the location of the neutral position of the control element. The adjusting element, which is displaceably arranged in the displacement direction, is displaceable via an actuating device during the operation of the valve actuating mechanism, for adjusting of the neutral position.

19 Claims, 4 Drawing Sheets

ELECTROMAGNETIC VALVE OPERATING DEVICE WITH ADJUSTABLE NEUTRAL POSITION

CROSS-REFERENCE TO RELATED APPLICATIONS

This application is a continuation of PCT Application No. PCT/EP2003/010330 filed on Sep. 17, 2003, which claims priority to German Application No. 102 48 330.2 filed Oct. 17, 2002.

BACKGROUND AND SUMMARY OF THE INVENTION

The present invention relates to an electromagnetic valve actuating mechanism.

An electromagnetic valve actuating mechanism of the generic type is disclosed, for example, from German Patent Document DE 694 09 485 T2. The valve actuating mechanism described there has a displaceable control element or an "armature" with an "armature plate", for actuating a valve of an internal-combustion engine (that is, an intake valve or an exhaust valve). The armature plate is arranged between two solenoids spaced away from one another in the displacement direction. One solenoid is arranged on the side of the armature plate close to the valve, and the other is arranged on the side away from the valve. In addition, two pressure springs are provided, one also being arranged on the side close to the valve, and the other on the side of the armature plate away from the valve. The pressure springs press the control element or the armature plate into a neutral position, in which the spring forces just barely cancel one another out. By energizing one or both solenoids, the control element or the armature plate can be deflected against the spring forces, so that the valve connected with the control element can be opened or closed.

In the neutral position of the control element, the valve is in a "center position", in which it is partially opened. For the precision adjusting of the neutral position, a hexagonal socket screw is provided which presses against the end of the pressure spring which is away from the valve. The two springs can be prestressed and thus the location of the neutral position of the control element relative to the solenoid can be changed, by rotating the adjusting screw.

Adjustment of the neutral position of the control element requires considerable labor and can be done only in the shop. However, a firmly adjusted neutral position of the control element is always a power-related "compromise" for some operating conditions of the engine. To open or close the valve, one or the other solenoid must be energized. To minimize the demand for electric power, it would be desirable for the neutral position of the control element to be changeable during the operation of the internal-combustion engine.

One object of the invention is to provide an electromagnetic valve actuating mechanism which exhibits an optimized power requirement.

This and other objects and advantages are achieved by the electromagnetic valve actuating mechanism according to the invention, which has an axially displaceable control element with an armature plate, for opening or closing a valve. In addition, two solenoids are provided which are arranged behind one another in the displacement direction and are spaced with respect to one another. One solenoid is arranged on the side of the armature plate close to the valve, and the other is arranged on the side of the armature plate away from the valve. Two springs arranged behind one another in the displacement direction—one on the side of the armature plate close to the valve, and the other on the side away from the valve—press the control element or the armature plate into a neutral position when the solenoids are without current. By energizing the solenoids, the control element or the armature plate can be deflected from the neutral position.

A stop element is provided at one end of the two springs. By adjusting the stop element, the springs can be prestressed, and thus the position of the neutral position of the control element changed with respect to the solenoids.

According to the invention, the stop element is displaceably arranged in the displacement direction of the control element, and an actuating device is provided which permits displacement of the stop element during the operation of the valve actuating mechanism. Thus, the neutral position of the control element can be adjusted during the operation of the engine, as a function of the load condition.

In other words, the neutral position, (in which the forces of the two springs just barely cancel one another out), can be displaced in the direction of the solenoid close to the valve or in the direction of the solenoid away from the valve. Depending on whether the valve is an intake valve or an exhaust valve, it is useful for power-related reasons to change the neutral position of the control element as a function of the loading condition of the internal-combustion engine, during operation.

In the case of the exhaust valve, it is useful, during the start of the engine or in the low-load operation, to bring the control element or the armature plate into a neutral position which corresponds to the center position between the two solenoids. In this neutral position, the armature plate is equally far away from both solenoids if they are not energized. On the other hand, in operation under a load, it is advantageous with respect to the power for the neutral position of the control element to be displaced toward the solenoid close to the valve, which can be done by actuating the actuating element, so that the stop element resting on one spring end can be displaced in the displacement direction of the control element. By displacing the stop element, the prestressing of the two springs, and thus the location of the neutral position, can be changed.

In contrast, in the case of an intake valve, it is advantageous for the control element or the armature plate not to be in the center position between the two solenoids after the engine start or during idling or in the partial-load operation but to be displaced toward the solenoid away from the valve. By actuating the actuating element, the control element can be displaced in the load operation, such that its neutral position corresponds to the center position between the two solenoids.

According to a further embodiment of the invention, a hydraulic actuating device is provided. The actuating device preferably has a swiveling lever with a short and a long lever arm. The short lever arm interacts with the stop element of the actuating device. In contrast, the long lever arm is acted upon by an adjusting force by means of a hydraulic cylinder. The hydraulic cylinder can be connected with the engine oil circulating system by way of a solenoid which can be shut off. In the load operation of the internal-combustion engine, the engine oil pressure is sufficiently high that, when the solenoid is opened, the swiveling arm can be actuated for the adjustment of the neutral position.

Since the required adjusting path of the control element from one neutral position to the other amounts to only a few tenths of a millimeter and the adjusting forces are relatively high, it is expedient to use a swiveling lever with a transmission ratio of 10 to 15 from the long to the short lever arm. By selection of a transmission ratio of from 10 to 15, the high force of the valve spring can be reduced to a lower force level, which can then be applied by the engine oil pressure and a piston with a relatively small piston surface. Such a large transmission ratio also reduces the effects of the tolerances in the piston travel which at an inverse to the transmission ratio have an effect on the neutral position, and thereby simplify the manufacturing of the hydraulic unit.

During actuation of the actuating device, the one end of the upper spring, or the spring away from the valve, is displaced by means of the swiveling lever by twice the amount of the desired neutral position adjustment in the displacement direction.

For precise adjustment of the neutral position, an adjusting screw may be provided at the short lever arm of the swiveling lever. The adjusting screw can be screwed directly into the short lever arm and can press against the stop element of the spring away from the valve. It is preferably secured against rotation by a screw retention device (for example, by means of a lock nut). Such an actuating device can be assigned to a single valve. However, preferably such an actuating device can be provided for adjusting the control elements of two or more valves.

When a hydraulic actuating device is used, the hydraulic pistons assigned to the intake valves or the exhaust valves can be mutually connected by a common oil pipe, and connected to the engine oil circulating system by means of a simple solenoid.

According to a further embodiment of the invention, the actuating device permits a "two-point adjustment". This means that the control element can be switched between precisely two neutral positions. In this case, no sensor system is required for detecting the location of the neutral position.

Alternatively, a continuous neutral position adjustment may also be provided by means of a corresponding control of the hydraulic pressure. Thus, not only an upper and a lower neutral position can be adjusted, but also arbitrary neutral positions situated in-between.

Other objects, advantages and novel features of the present invention will become apparent from the following detailed description of the invention when considered in conjunction with the accompanying drawings.

DETAILED DESCRIPTION OF THE DRAWINGS

Figure 1:
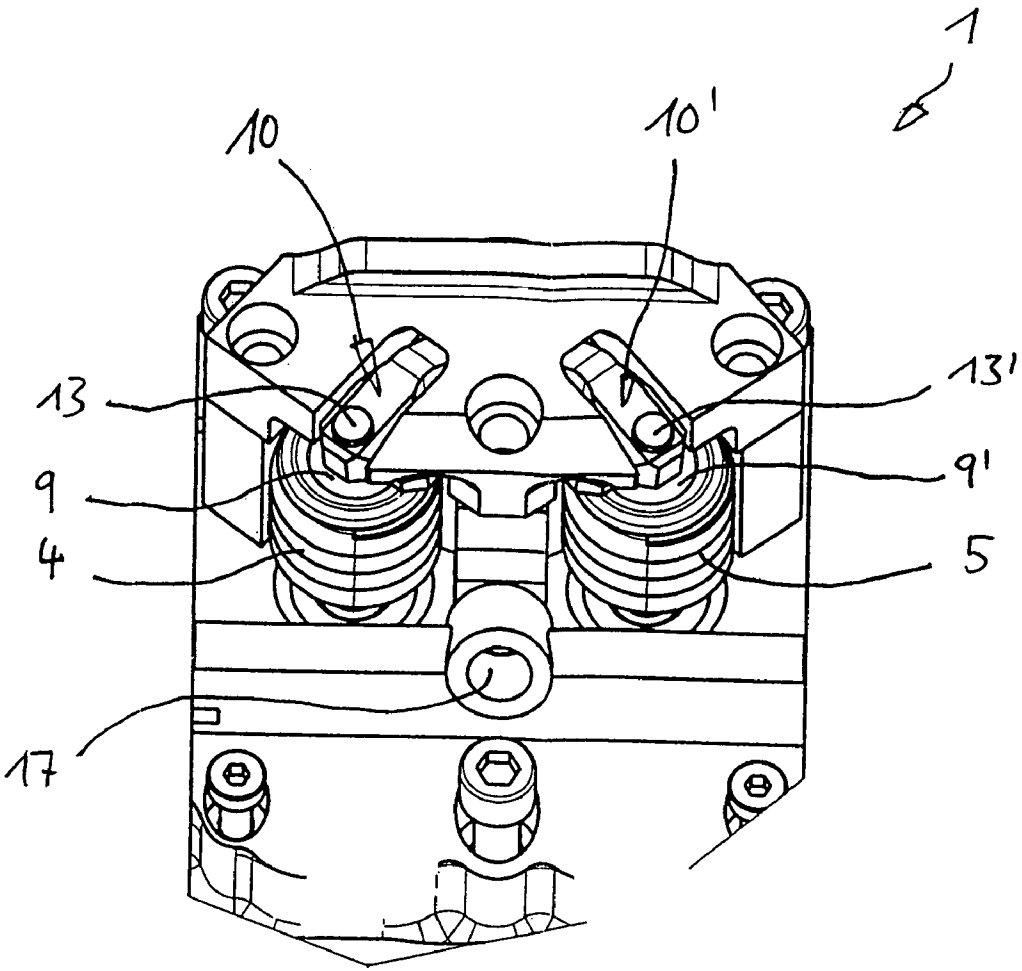
FIG. 1 is a perspective view of a neutral position adjusting device.

FIG. 1 illustrates an actuator 1 of an electromagnetic mechanism for actuating two valves of an internal combustion engine, for example, two exhaust valves or two intake valves. (The valves themselves are not shown.) For the valve actuation, a control element formed by an armature rod 2 (compare FIGS. 2, 3) and an armature plate 3 (FIG. 4) is assigned to each valve. One valve spring respectively is provided on each of the two sides of the armature plate, in FIGS. 1 to 3. (Only an upper valve spring is illustrated, which can also be called a valve spring 4, 5 away from the valve.)

The basic construction of such a control element with two inversely operating valve springs is known. See, for example, from German Patent Document DE 694 09 485 T2, the disclosure of which is incorporated by reference herein, The two valve springs (of which here only the upper valve springs 4, 5 are shown) press the armature rod 2 together with its armature plate 3 into a neutral position, in which the forces of the mutually opposing upper and lower valve springs just barely cancel one another out. In the neutral position of the armature rod or of the armature plate, the valve interacting with the armature rod is partially (for example, half) opened. For the complete opening or closing of the valves, each valve has a solenoid close to the valve and a solenoid away from the valve.

Figure 2:
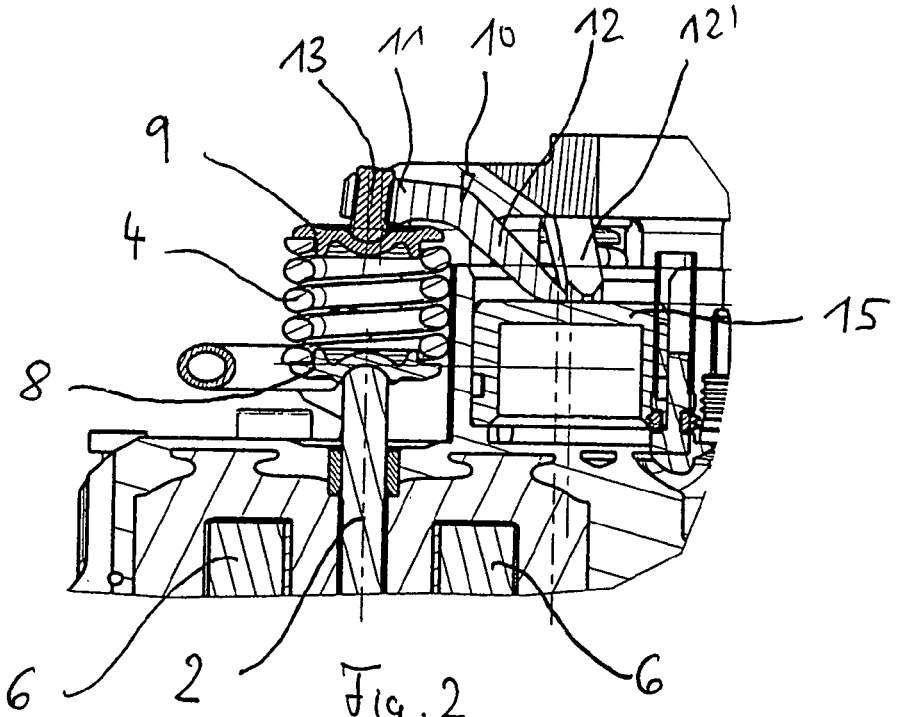
FIG. 2 is a cross-sectional view of a neutral position adjusting device in a deactivated position.
Figure 3:
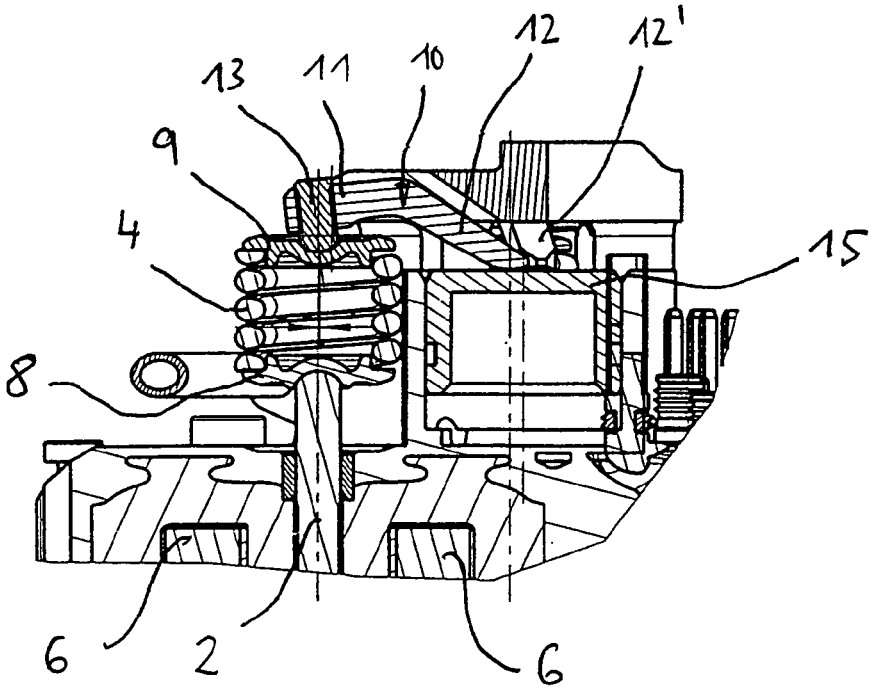
FIG. 3 is a view of the neutral position adjusting device in an activated position.

FIGS. 2 and 3 each show only the solenoid 6 away from the valve which is arranged above the armature plate.

Figure 4:
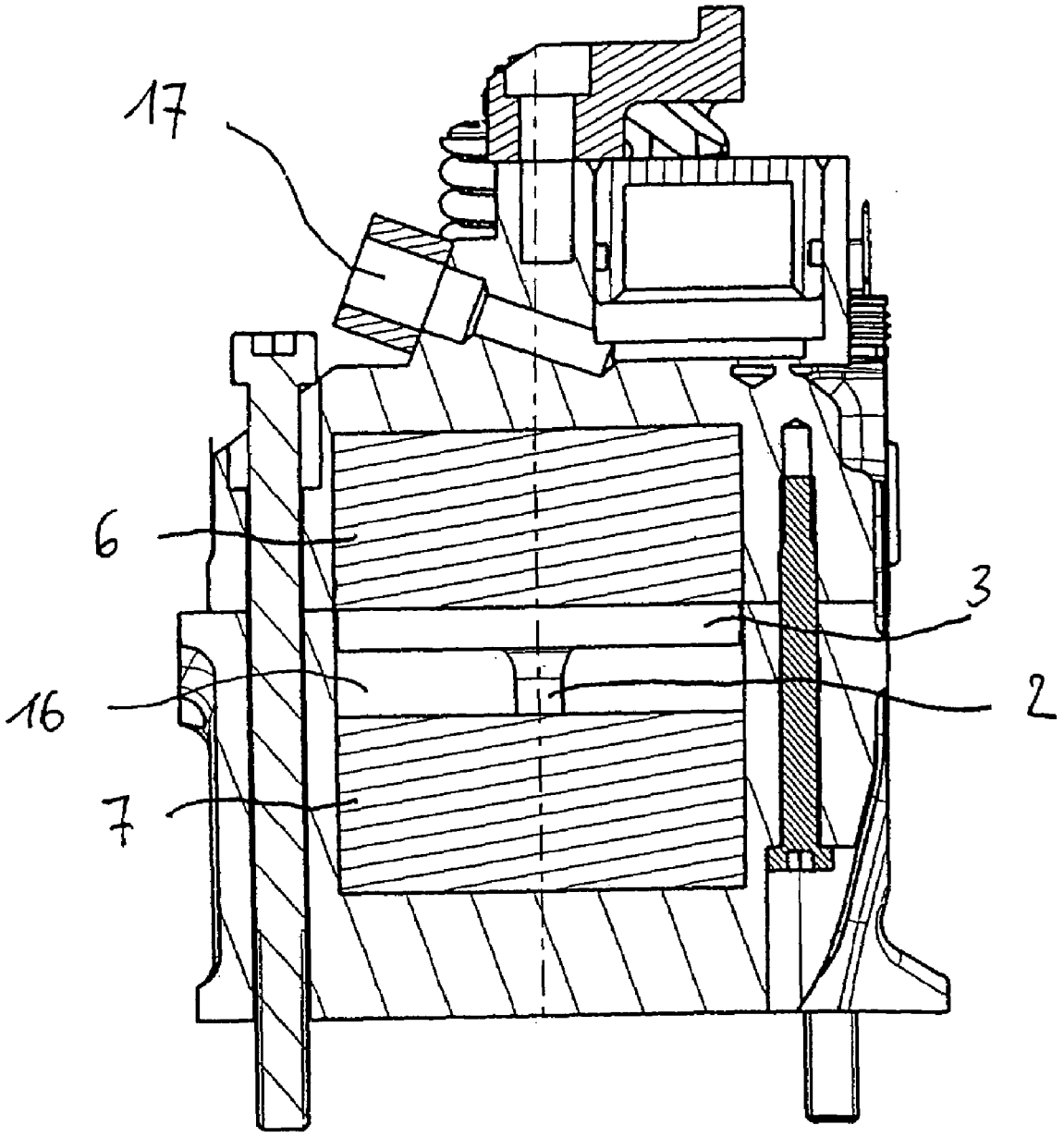
FIG. 4 is a sectional view of the valve actuating mechanism when the valve is closed.

FIG. 4 shows the solenoid 7 close to the valve. The two solenoids 6, 7 are spaced away from one another in the displacement direction of the armature rod 2 or the armature plate 3. In the switching condition of FIG. 4, the solenoid 6 away from the valve is energized, so that the armature plate 3 is attracted by the solenoid away from the valve, and the valve connected with the armature rod 2 is closed.

In the illustrated embodiment, a stop element 8 for supporting the upper valve spring 4, 5 is mounted at the end of the armature rod 2 away from the valve. Furthermore, another stop element 9 is provided, so that the valve spring 4 away from the valve is clamped between the two stop elements 8, 9. The upper stop element 9 is acted upon by a swiveling lever 10 or 10', which has a short lever arm 11 or 11' and a long lever arm 12 or 12'. One adjusting screw 13, 13', which is screwed into each short lever arm 11, 11', presses directly against the upper stop element 9 or 9'. By the rotating the adjusting screw 13, 13', the neutral position of the armature rod 2 or the armature plate 3 can be adjusted precisely.

Figure 5:
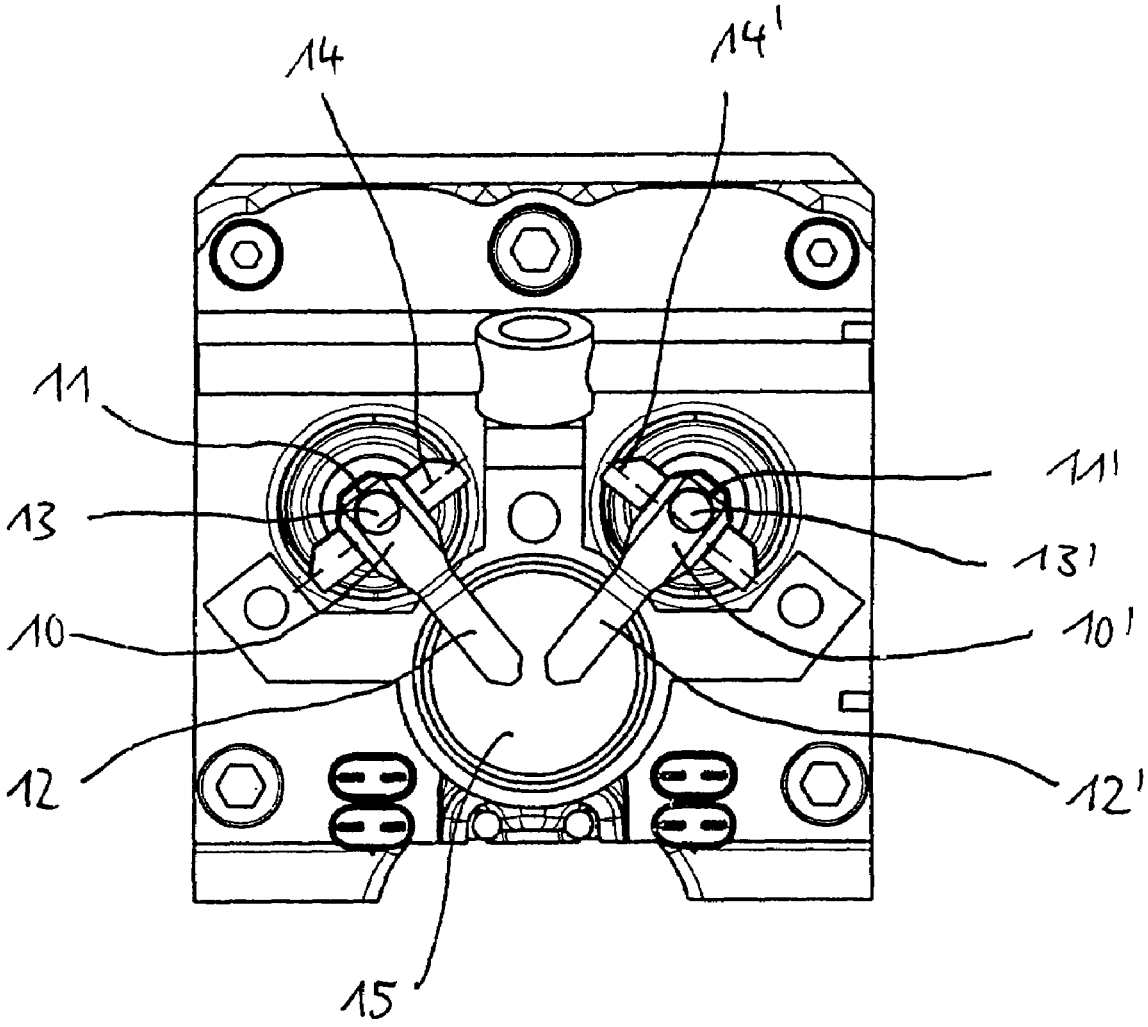
FIG. 5 is a top view of the neutral position adjusting device.

As best illustrated in FIG. 5, the swiveling levers 10 can each be swiveled about a swiveling axis 14, 14' (illustrated by a broken line), and which divides the swiveling lever 10, 10' into the short lever arm 11, 11' and the long lever arm 12, 12'.

As best illustrated in FIGS. 2, 3 and 5, the two long lever arms 12, 12' are acted upon by a joint piston 15, which is hydraulically actuated. The piston 15 can be connected to the engine oil circulating system by means of a solenoid which can be shut off.

FIG. 2 shows the deactivated condition. In this condition, the piston 15 is not acted upon by engine oil pressure. In contrast, FIG. 3 shows a condition in which the hydraulic piston 15 is displaced upwards by engine oil pressure. Correspondingly, the swiveling lever 10 is swiveled counterclockwise. By means of the short lever arm 11 of the swiveling lever 10, the upper stop element 9 is pressed downward. As a result, the spring 4 away from the valve and the assigned spring 5 close to the valve are compressed, so that the two springs are continuously prestressed. In addition, the armature rod 2 or the armature plate 3 are thereby displaced in the direction of the solenoid close to the valve (compare FIG. 4). Thus, by actuating the piston 15, the neutral position of the armature rod 2 or of the armature plate 3 can be changed inside the space 16 (compare FIG. 4) provided between the solenoid 6 away from the valve and the solenoid 7 close to the valve.

As an alternative to the embodiment illustrated here, a separate actuating device (that is, a separate piston 15) can be assigned to each valve or, more precisely, to each valve rod or each armature plate.

For reasons of completeness, reference is also made to the oil feed 17 (compare FIGS. 1, 4) by means of which the valve actuating mechanism is supplied with engine oil.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electromagnetic valve actuating mechanism for an internal-combustion engine, comprising:

an axially displaceable control element with an armature plate, for opening or closing a valve that is connected to the control element;

first and second solenoids spaced apart from each other and arranged behind one another in a displacement direction of the control element, the first solenoid being arranged on a side of the armature plate close to the valve, and the second solenoid being arranged on a side of the armature plate away from the valve;

first and second springs arranged behind one another in the displacement direction, the first spring being arranged on a side of the armature plate close to the valve, and the second spring being arranged on a side of the armature plate away from the valve, said springs holding the control element in a neutral position when the solenoids are currentless, the control element being deflectable from the neutral position by energizing the solenoids; and an adjusting element which supports an end of one of the two springs, which end is remote from the armature plate, wherein, prestressing of the springs can be adjusted, and thus the location of the neutral position of the control element can be changed, by adjustment of the adjusting element;

the adjusting element is displaceably arranged in the displacement direction;

an actuating device is provided which permits displacement of the adjusting element during operation of the valve actuating mechanism, and thus adjustment of the neutral position;

the actuating device comprises, an actuation element which is displaceable along a second axis that is parallel and adjacent to a displacement axis of the control element; and a mechanical coupling, which translates said displacement of said actuation element alone said second axis, to a corresponding displacement of the adjusting element alone said displacement axis.

2. The electromagnetic valve actuating mechanism according to claim 1, wherein the valve can be displaced by the control element from its neutral position into an opening position and into a closing position.

3. The electromagnetic valve actuating mechanism according to claim 1, wherein, in a first neutral position of the control element, the armature plate is, in each case, spaced equally far away from the two solenoids when the actuating device is inoperative.

4. The electromagnetic valve actuating mechanism according to claim 3, wherein the valve is an exhaust valve.

5. The electromagnetic valve actuating mechanism according to claim 4, wherein, by actuating the actuating device, the control element can be displaced into a second neutral position, in which a distance of the armature plate from the first solenoid is smaller than a distance of the armature plate from the second solenoid.

6. The electromagnetic valve actuating mechanism according to claim 2, wherein, in the neutral position of the control element, the armature plate is spaced at different distances from the two solenoids when the actuating device is inoperative.

7. The electromagnetic valve actuating mechanism according to claim 6, wherein, by actuating the actuating device, the control element can be displaced into a different neutral position, in which the armature plate is at an equal distance from the two solenoids.

8. The electromagnetic valve actuating mechanism according to claim 6, wherein, in the neutral position of the control element, the distance between the armature plate and the first solenoid is larger than the distance between the armature plate and the second solenoid.

9. The electromagnetic valve actuating mechanism according to claim 8, wherein the valve is an intake valve.

10. The electromagnetic valve actuating mechanism according to claim 1, wherein said mechanical coupling has a transmission ratio such that a magnitude of a displacement of said actuation element is reduced by a factor of 10 to 15 for displacing said adjusting element.

11. The electromagnetic valve actuating mechanism according to claim 1, wherein:

a first end of at least one of said springs is supported on a stop element disposed at an end of said control element; and a second end of said at least one of said springs is supported on a stop that is disposed on said adjusting element.

12. The electromagnetic valve actuating mechanism according to claim 1, wherein said mechanical coupling comprises a swivel lever.

13. An electromagnetic valve actuating mechanism for an internal-combustion engine, comprising:

an axially displaceable control element with an armature plate, for opening or closing a valve;

first and second solenoids spaced apart from each other and arranged behind one another in a displacement direction, the first solenoid being arranged on the side of the armature plate close to the valve, and the second solenoid being arranged on the side of the armature plate away from the valve;

first and second springs arranged behind one another in the displacement direction, the first spring being arranged on a side of the armature plate close to the valve, and the second spring being arranged on a side of the armature plate away from the valve, said springs holding the control element in a neutral position when the solenoids are currentless, the control element being deflectable from the neutral position by energizing the solenoids; and an adjusting element which supports an end of one of the two springs, which end is remote from the armature plate, wherein, prestressing of the springs can be adjusted, and thus the location of the neutral position of the control element can be changed, by adjustment of the adjusting element;

the adjusting element is displaceably arranged in the displacement direction;

an actuating device is provided which permits displacement of the adjusting element during operation of the valve actuating mechanism, and thus adjustment of the neutral position;

the actuating device has a swivelling lever with a short lever arm and a long lever arm;

the short lever arm interacts with the adjusting element; and the long lever arm is actuatable by an adjusting force by means of a hydraulic piston.

14. The electromagnetic valve actuating mechanism according to claim 13, wherein the hydraulic piston is arranged in a hydraulic cylinder which is connected to the engine oil circulating system.

15. The electromagnetic valve actuating mechanism according to claim 14, wherein the hydraulic cylinder is connected to the engine oil circulating system by means of a solenoid, which can be shut off.

16. The electromagnetic valve actuating mechanism according to claim 15, wherein an adjusting screw is provided on the short lever arm, for a fine adjustment of the neutral position.

17. An actuating mechanism for an electromagnetically actuated valve in a motor vehicle, said mechanism comprising:

a control element comprising an armature rod with an armature plate, for opening and closing a valve that is connected to the control element, said control element being displaceable along a longitudinal axis of said armature rod, between open and closed positions of said valve;

first and second springs disposed on opposite sides of said armature plate, and bearing against opposite ends of said control element, said springs being biased to maintain said control element in a neutral position intermediate said open and closed positions;

first and second solenoids which are actuatable to displace said control element out of said neutral position into said open and closed positions, respectively;

an adjusting element that supports an end of one of said first and second springs which is remote from the armature plate; and an actuating mechanism for displacing said adjusting element along said longitudinal axis of said armature rod; wherein said actuating mechanism comprises, a hydraulic piston; and a swiveling lever that has respective first and second swivel arms, said first swivel arm bearing against said adjusting element, and said second swivel arm being actuatable by an adjusting force of said hydraulic piston.

18. The electromagnetic valve actuating mechanism according to claim 17, wherein the hydraulic cylinder is connected to the engine oil circulating system by means of a solenoid, which can be shut off.

19. The electromagnetic valve actuating mechanism according to claim 18, wherein the hydraulic cylinder is connected to the engine oil circulating system by means of a solenoid, which can be shut off.

* * * * *